US010315298B2

(12) United States Patent
Herr et al.

(10) Patent No.: US 10,315,298 B2
(45) Date of Patent: Jun. 11, 2019

(54) IMPACT MECHANISM DEVICE

(71) Applicant: Robert Bosch GmbH, Stuttgart (DE)

(72) Inventors: Tobias Herr, Stuttgart (DE); Steffen Tiede, Herrenberg (DE); Benjamin Nikolas Fischle, Murr (DE); Hardy Schmid, Stuttgart (DE); Gerd Schlesak, Tamm (DE); Selim Mustafa, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 1233 days.

(21) Appl. No.: 14/315,402

(22) Filed: Jun. 26, 2014

(65) Prior Publication Data

US 2015/0000947 A1 Jan. 1, 2015

(30) Foreign Application Priority Data

Jun. 28, 2013 (DE) ..... 10 2013 212 753

(51) Int. Cl.

*B25D 16/00* (2006.01)
*B25D 11/08* (2006.01)
*B25D 17/06* (2006.01)

(52) U.S. Cl.

CPC ..... *B25D 11/08* (2013.01); *B25D 16/006* (2013.01); *B25D 17/06* (2013.01); *B25D 2216/0015* (2013.01); *B25D 2216/0023* (2013.01); *B25D 2216/0038* (2013.01); *B25D 2217/0023* (2013.01); *B25D 2222/24* (2013.01); *B25D 2222/54* (2013.01)

(58) Field of Classification Search

CPC .... B25D 11/08; B25D 11/10; B25D 2211/064
USPC ..... 173/202
See application file for complete search history.

(56) References Cited

U.S. PATENT DOCUMENTS

| | | | | |
|---|---|---|---|---|
| 4,828,046 | A * | 5/1989 | Pyatov | B25D 11/125 173/14 |
| 7,350,592 | B2 * | 4/2008 | Hahn | B25D 11/104 173/109 |
| 8,464,805 | B2 * | 6/2013 | Baumann | B25D 11/062 173/109 |
| 2010/0300719 | A1 * | 12/2010 | Fisher | B25D 11/005 173/205 |
| 2010/0326688 | A1 * | 12/2010 | Ullrich | B25D 17/06 173/114 |

FOREIGN PATENT DOCUMENTS

| | | | |
|---|---|---|---|
| CN | 2280604 | Y | 5/1998 |
| CN | 1817568 | A | 8/2006 |
| DE | 28 20 125 | A1 | 11/1979 |
| DE | 31 06 487 | A1 | 9/1982 |
| DE | 34 02 728 | A1 | 8/1985 |

(Continued)

*Primary Examiner* — Chelsea E Stinson
(74) *Attorney, Agent, or Firm* — Maginot, Moore & Beck LLP

(57) ABSTRACT

An impact mechanism device for a hand power tool comprises at least one impact mechanism including at least one driven cylinder and at least one piston driven in an axial direction by the at least one driven cylinder via a cam mechanism, and at least one planetary gearing configured to drive the at least one driven cylinder and the at least one piston. The at least one piston is positioned at least partially inside the at least one driven cylinder.

14 Claims, 5 Drawing Sheets

(56) References Cited

FOREIGN PATENT DOCUMENTS

| | | | |
|---|---|---|---|
| DE | 10 2011 089 910 | A1 | 6/2013 |
| EP | 0 016 771 | B1 | 10/1980 |
| EP | 1 690 642 | A1 | 8/2006 |

* cited by examiner

IMPACT MECHANISM DEVICE

This application claims priority under 35 U.S.C. § 119 to patent application no. DE 10 2013 212 753.7, filed on Jun. 28, 2013 in Germany, the disclosure of which is incorporated herein by reference in its entirety.

BACKGROUND

There has already been proposed an impact mechanism device for a hand power tool, comprising at least one impact mechanism, which has at least one driven cylinder and at least one piston that is driven in an axial direction by the cylinder, via a cam mechanism, and comprising at least one planetary gearing, via which the cylinder and the piston of the impact mechanism can be driven.

SUMMARY

The disclosure is based on an impact mechanism device for a hand power tool, comprising at least one impact mechanism, which has at least one driven cylinder and at least one piston that is driven in an axial direction by the cylinder, via a cam mechanism, and comprising at least one planetary gearing, via which the cylinder and the piston of the impact mechanism can be driven.

It is proposed that the piston of the impact mechanism be disposed at least partially inside the driven cylinder. A "hand power tool" is to be understood to mean, in particular, a machine that performs work on workpieces, but advantageously a rotary hammer and/or percussion hammer and/or a multifunction tool. An "impact mechanism" in this case is to be understood to mean, in particular, a device provided to generate percussion impulses, which are transmitted to a tool clamped in a tool receiver in order to convert a chiseling or hammer drilling operating mode, the impact mechanism being provided to convert a rotary motion into a linear impact motion. The impact mechanism in this case preferably has a piston that, by means of an axial motion, generates a pressure impulse inside the hammer tube of the impact mechanism, the pressure impulse being taken up by an impact element and transmitted to the tool fastened in the tool receiver. A "driven cylinder" in this case is to be understood to mean an element that, at least substantially, has a hollow-cylinder cross section and that is driven rotationally about its central axis. A "cam mechanism" in this case is to be understood to mean, in particular, a device for converting a rotational motion into a linear motion. The linear motion in this case is preferably oriented in the axial direction. The cam mechanism in this case comprises a guide element, which is preferably realized as a groove, and a form closure element, which is in form-closed contact with the cam element for the purpose of guidance. An "axial direction" in this case is to be understood to mean, in particular, a direction that is parallel to a main direction of rotation of a tool clamped in a tool receiver. A "planetary gearing" in this context is to be understood to mean, in particular, a toothed wheel gearing having a sun gear, a planet carrier, at least one planet gear that is carried on a circular orbit around the sun gear by the planet carrier, and having a ring gear that meshes radially outwardly with the at least one planet gear. "At least partially inside" in this case is to be understood to mean, in particular, that at least a part of the piston is disposed inside the cylinder. It is thereby possible to achieve an impact mechanism device that is advantageously short in the axial direction, thus making it possible, in particular, to provide a particularly advantageously compact hand power tool.

Further, it is proposed that the piston be realized as a hollow piston, which is moved axially to generate a pressure impulse. A "hollow piston" in this case is to be understood to mean, in particular, a piston having a basic shape of a hollow cylinder, the piston being open on one axial side and closed on an opposite side. An axial motion of the piston causes a pressure impulse to be generated inside the piston, which pressure impulse encounters an element disposed inside the piston, such as, in particular, a striker of the impact mechanism, which takes up the pressure impulse and transmits it, directly or via further intermediate elements, to a tool in the tool receiver. As a result, particularly advantageously, the piston can be realized for a short impact mechanism structure.

It is additionally proposed that the piston have, on its outer circumference, an outer curve that realizes the piston-side cam mechanism. An "outer curve" in this case is to be understood to mean, in particular, a guide path disposed on an outer circumference of the piston, the guide path preferably being realized as a groove. As a result, the cam mechanism can be realized in a particularly advantageous manner.

Furthermore, it is proposed that the piston have, on its outer circumference, a further outer curve that, together with the one outer curve, realizes the piston-side cam mechanism. A "further outer curve" in this case is to be understood to mean, in particular, an outer curve realized so as to be identical in its course to the other outer curve of the piston-side cam mechanism, only disposed in an offset manner in the circumferential direction on the outer circumference of the piston. The outer curves in this case are preferably disposed in a non-uniformly distributed manner on the circumference. The outer curves in this case are distributed on the circumference at an angular distance of other than 180 degrees. As a result, forces can be apportioned advantageously to the outer curves and to the form closure elements engaging in the outer curves, and consequently reduced for each individual element, enabling a service life of the impact mechanism device to be increased in a particularly advantageous manner.

It is further proposed that the outer curve and the further outer curve be distributed in a non-uniform manner on the outer circumference of the piston. "Distributed in a non-uniform manner on the circumference" is to be understood to mean, in particular, that the outer curves at an axial position in a first circumferential direction are at a different distance from each other than in an opposite, second circumferential direction. The outer curves in this case have, in particular, an angular distance from each other that is other than 180 degrees. As a result, particularly advantageously, it is possible to prevent a collision of form closure elements engaging in the different outer curves.

Moreover, it is proposed that the piston be composed of a first, lighter material, and the outer curve be composed of a second, harder material. A "first, lighter material" in this case is to be understood to mean, in particular, a light metal, a plastic, or another light material considered appropriate by persons skilled in the art. A "harder material" in this case is to be understood to mean, in particular, a material that is harder and more wear resistant than the first material. In this case, the "second, harder material" is to be understood to mean, in particular, a material that has been hardened, or that has been coated to increase wear resistance, and that, in particular, has a greater hardness. As a result, the piston can be made particularly light and, at the same time, particularly advantageously, the curved path can be particularly wear resistant, thus making it possible, in particular, to achieve advantageous quietness of running and a particularly advantageous wear behavior of the impact mechanism device.

It is furthermore proposed that the cylinder have at least one form closure element, which engages in the outer curve for the purpose of guiding the piston. As a result, the cam mechanism can be realized in a particularly advantageous manner.

Further, it is proposed that the cylinder be driven via a first output of the at least one planetary gearing, and the piston be driven via a second output of the at least one planetary gearing. An "output of a planetary gearing" in this case is to be understood to mean, in particular, an element of the planetary gearing such as, in particular, a sun gear, a ring gear or a planet carrier, via which a moment is diverted out of the planetary gearing. As a result, the impact mechanism device can be realized in a particularly advantageous manner, and a differential rotational speed can be achieved between the piston and the cylinder.

Moreover, it is proposed that the first output, via which the cylinder is driven, be realized as a sun gear of the second planetary gearing. As a result, the impact mechanism device can be realized in a particularly advantageously compact manner.

Furthermore, it is proposed that the impact mechanism device comprise at least one switching device, which is provided for mechanical switching of various operating modes. "Mechanical switching" in this case is to be understood to mean, in particular, switching that is preferably effected purely mechanically, i.e. in which a force and/or a movement initiated by an operator is taken up by a mechanism and a switching operation is converted by a movement of the mechanism, the mechanical switching, in particular, not making use of an electronic component. In this way, particularly advantageously, various operating modes can be switched by an operator.

In addition, it is proposed that the switching device comprise at least one slide sleeve, which has form closure elements for coupling to a tool receiver and for actuating a coupling point of the switching device for the purpose of coupling the piston. A "slide sleeve" in this case is to be understood to mean, in particular, a sleeve that is mounted so as to be axially displaceable and that, because of its design, switches differing operating states in differing positions. As a result, the various operating states can be switched particularly easily.

Further, it is proposed that the coupling point of the switching device comprise radially displaceable form closure elements, which are optionally held in a form closure or released by the slide sleeve, for the purpose of coupling and decoupling the piston. "Decoupling the piston" in this case is to be understood to mean, in particular, undoing a rotationally fixed connection between the piston and a drive, such that the piston is no longer driven rotationally. "Coupling the piston" in this case is to be understood to mean, in particular, establishing a rotationally fixed connection between the piston and a drive, such that the piston is driven rotationally. As a result, a percussive operating mode of the impact mechanism can be switched particularly easily and rapidly.

It is further proposed that the impact mechanism device have a mechanical switchover unit, which, for the purpose of switching over a direction of rotation of a tool receiver, is provided to fix optionally a ring gear or a planet carrier of the second planetary gearing. The term "to fix" in this case is to be understood to mean, in particular, to connect to a housing element in a rotationally fixed manner. As a result, a direction of rotation of a tool that is clamped in the tool receiver can be switched over by an operator in an advantageously simple and rapid manner.

The impact mechanism device according to the disclosure is not intended in this case to be limited to the application and embodiment described above. In particular, the impact mechanism device according to the disclosure may have individual elements, components and units that differ in number from a number stated herein, in order to fulfill a principle of function described herein.

Further advantages are given by the following description of the drawings. The drawings show five exemplary embodiments of the disclosure. The drawing, the description and the claims contain numerous features in combination. Persons skilled in the art will also expediently consider the features individually and combine them to create appropriate further combinations.

DETAILED DESCRIPTION

Figure 1:
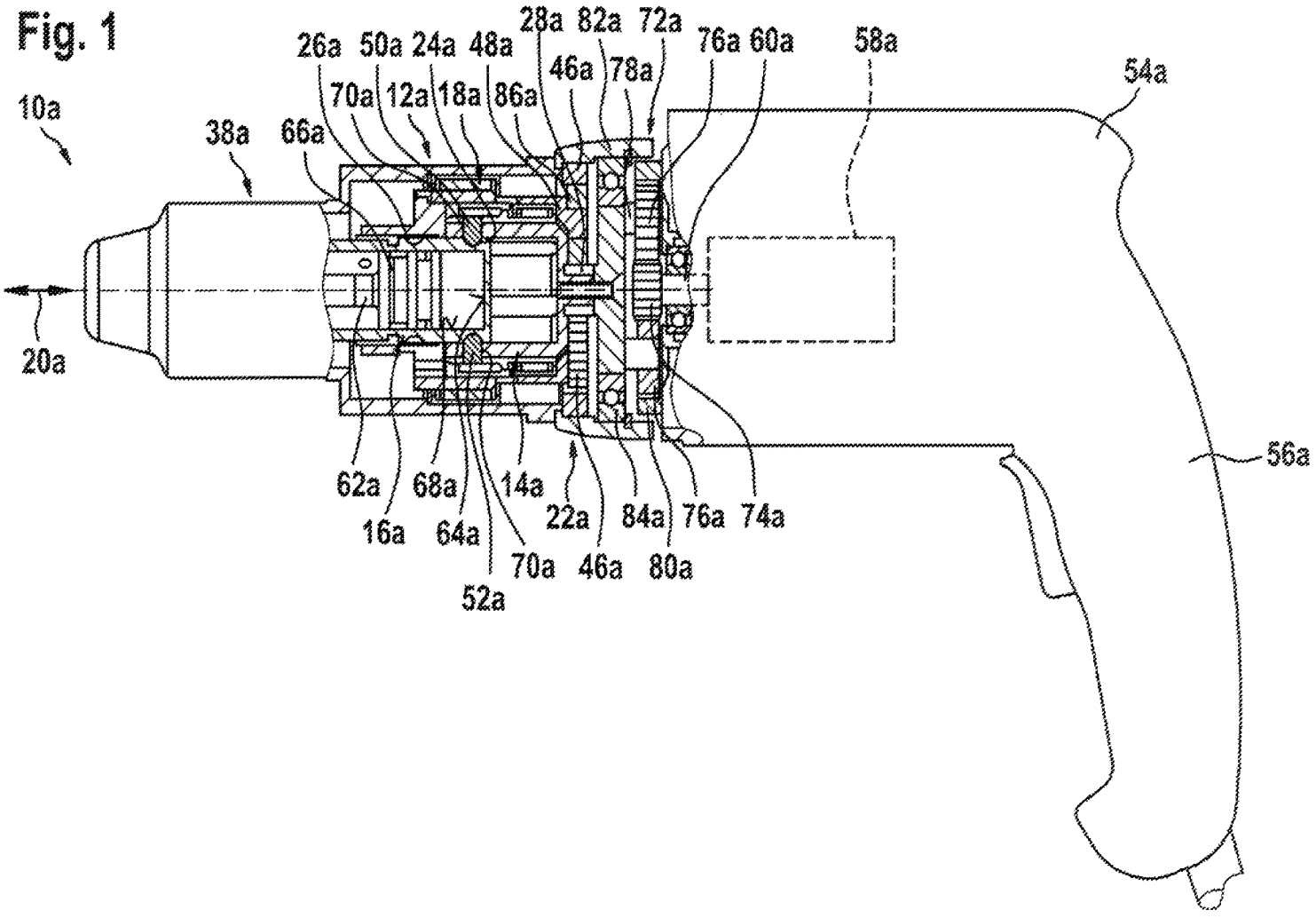
FIG. 1 shows a hand power tool comprising an impact mechanism device according to the disclosure, in a first exemplary embodiment.
Figure 2:
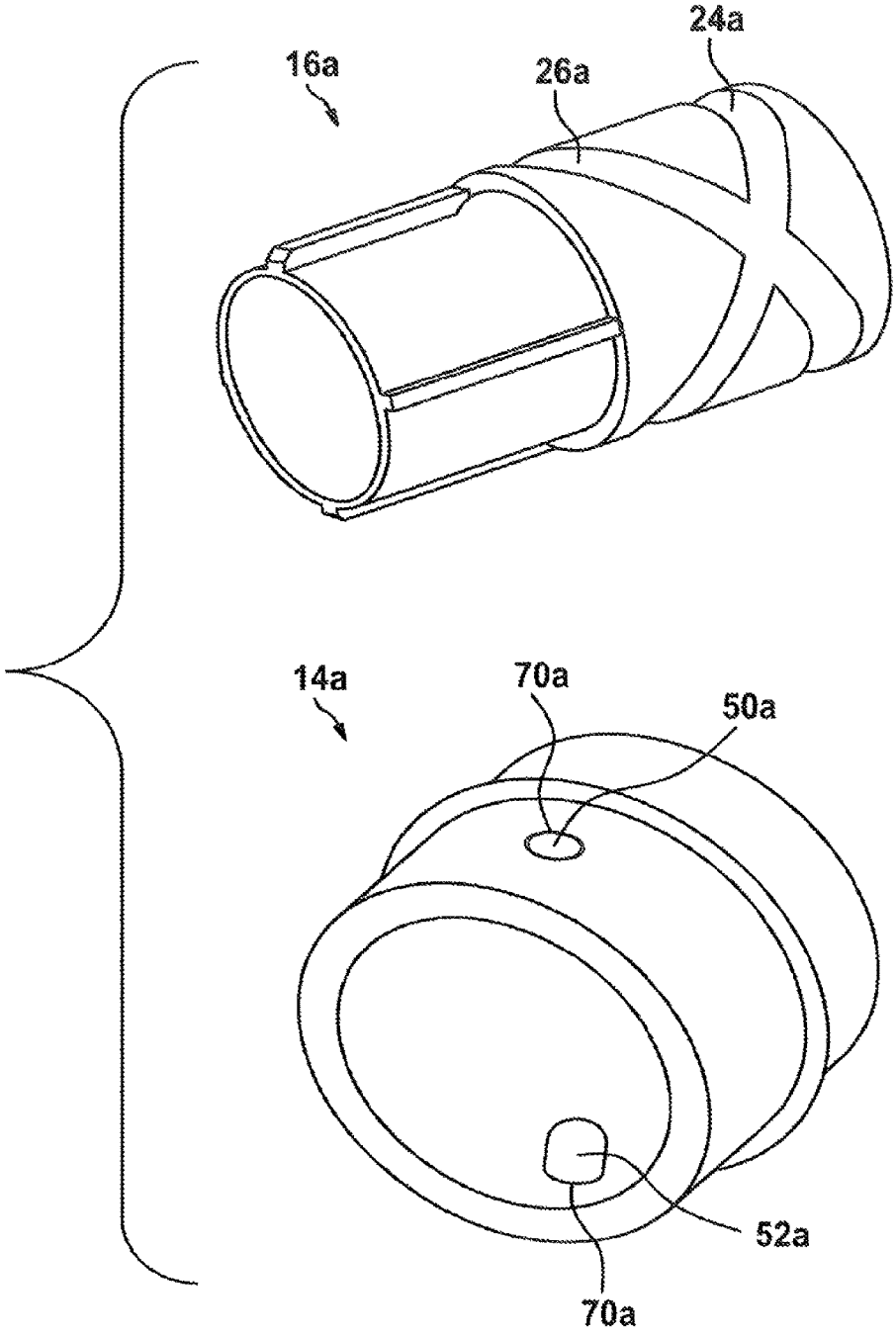
FIG. 2 shows a cylinder and a piston of an impact mechanism device according to the disclosure, in a first exemplary embodiment.

FIGS. 1 and 2 show a hand power tool 10*a*, comprising an impact mechanism device according to the disclosure, in a first exemplary embodiment. The hand power tool 10*a* is realized as a rotary hammer. The hand power tool 10*a*, realized as a rotary hammer, has a pistol-shaped machine housing 54*a*, in which the impact mechanism device according to the disclosure is disposed. A handle 56*a*, which comprises an operating element, is disposed on the machine housing 54*a*. The hand power tool 10*a* can be actuated via the operating element. It is also conceivable in principle for the hand power tool 10*a* to have a machine housing of a different design, considered appropriate by persons skilled in the art. For the purpose of driving the hand power tool 10*a*, the hand power tool 10*a* comprises a drive unit 58*a*. The drive unit 58*a* in this case is realized as an electric motor. It is also conceivable in principle for the drive unit 58*a* to be realized as a different drive unit 58*a*, considered appropriate by persons skilled in the art. In this case, the drive unit 58*a* is merely indicated in FIG. 1. The hand power tool 10*a* comprises a drive shaft 60*a*, which is driven rotationally by the drive unit 58*a*. The hand power tool 10*a* comprises a tool receiver 38*a*, which is disposed at a front end of the hand power tool 10*a*. The tool receiver 38*a* is provided to receive a tool. The tool in this case may be realized as a chisel or, for example, as a drill bit.

The impact mechanism device is provided to drive the tool receiver 38*a*, and in particular a tool clamped in the tool receiver 38*a*. The impact mechanism device comprises an impact mechanism 12*a*. The impact mechanism 12*a* in this case is provided to transmit an impulse to the tool mounted in the tool receiver 38*a*. For this purpose, the impact mechanism 12*a* comprises an impact element 62*a*, which is mounted so as to be axially displaceable in relation to the tool receiver 38*a*, and which is provided to transmit an impulse to the tool mounted in the tool receiver 38*a*. The impact element 62*a* in this case is provided to transmit a pneumatic pressure impulse, acting upon one side of the impact element 62*a*, to the tool. In order to generate the pneumatic pressure impulse, the impact mechanism 12*a* has a piston 16*a*. The piston 16*a* is provided to generate the pneumatic pressure impulse that acts upon the impact element 62*a*, by means of an axial motion. The piston 16*a* in this case is realized as a hollow piston. The piston 16*a* has a hollow-cylinder basic body. In this case, a central recess in the piston 16*a* is open on one axial side, and closed on an opposite axial side. The recess in the piston 16*a*, which realizes the piston 16*a* as a hollow piston, is realized as a blind hole. The piston 16*a* is open at a first end and closed by a wall 64*a* at a second end. In this case, in a mounted state, the first end, at which the recess is open, is aligned in the direction of the tool receiver 38*a*, i.e. in a front region of the hand power tool 10*a*. The impact element 62*a* in this case is disposed inside the piston 16*a* that is realized as a hollow piston. The impact element 62*a* in this case projects from the first end into the recess of the hollow piston. In this case, the impact element 62*a* is disposed so as to be axially movable inside the piston 16*a*. The impact element 62*a* in this case realizes a sealing element 66*a* at a first end, which faces away from the tool receiver 38*a*. The sealing element 66*a* bears against an inner wall 68*a* of the piston 16*a* realized as a hollow piston, and thereby seals off a pressure chamber between the wall 64*a*, which delimits the recess of the piston 16*a*, and the sealing element 66*a*. The piston 16*a* in this case is composed of a first, light material. The piston 16*a* in this case is composed of a light metal, in particular an aluminum. Clearly, it is also conceivable in principle for the piston 16*a* to be composed of another material, considered appropriate by persons skilled in the art, such as, for example, another metal such as, in particular, another light metal or plastic.

For the purpose of driving the piston 16*a* in the axial direction, i.e. for the purpose of generating the pressure impulse by means of the piston 16*a*, the impact mechanism 12*a* has a cylinder 14*a*. The cylinder 14*a* is realized as a hollow cylinder, which is closed on one side by a wall. The cylinder 14*a* is provided to move the piston 16*a* back and forth axially. The impact mechanism device comprises a cam mechanism 18*a*, for driving the piston 16*a* axially. The piston 16*a* in this case is driven in the axial direction by the cylinder 14*a*, via the cam mechanism 18*a*. For the purpose of realizing the cam mechanism 18*a* on the piston side, the piston 16*a* has a first outer curve 24*a* on its outer circumference. The first outer curve 24*a* is realized as a groove made in the outside of the piston 16*a*. In this case, the groove constituting the first outer curve 24*a* has a semicircular cross section. Owing to the semicircular cross section, unfavorable notch effects can be reduced, as compared with a rectangular cross section. For the purpose of realizing the cam mechanism 18*a* on the piston side, the piston 16*a* has a second outer curve 26*a*. The second outer curve 26*a* is likewise constituted by a groove. In this case, the groove is identical in form to the groove constituting the first outer curve 24*a*. The first outer curve 24*a* and the second outer curve 26*a* each have a course that is identical to the other. The first outer curve 24*a* and the second outer curve 26*a* are disposed in an offset manner on the outer circumference of the piston 16*a*. In this case, the outer curves 24*a*, 26*a* are distributed in a non-uniform manner on the outer circumference of the piston 24*a*. On the outer circumference of the piston 16*a*, the outer curves 24*a*, 26*a* have an angular distance from each other that is other than 180 degrees. The outer curves 24*a*, 26*a* realize a wave shape, aligned in the axial direction, on the outer circumference. The outer curves 24*a*, 26*a* in this case each realize a sine shape. However, it is also conceivable in principle for the outer curves 24*a*, 26*a* to have a wave shape other than a sine shape. The outer curves 24*a*, 26*a* in this case are composed of a second, harder material. In this case, the outer curves 24*a*, 26*a* are composed of a hardened material. It is conceivable in this case for the outer curves and the piston to be produced in a multicomponent process. Owing to the second, harder material, the outer curves 24*a*, 26*a* are realized so as to be more resistant to wear than a remainder of the piston 16*a*. It is also conceivable in principle in this case for the outer curves 24*a*, 26*a* to have a coating by which the outer curves 24*a*, 26*a* are made more resistant to wear. It is also conceivable in principle for the outer curves 24*a*, 26*a* to be made harder than the rest of the piston 16*a* in another way, considered appropriate by persons skilled in the art. The cam mechanism 18*a* comprises two form closure elements 50*a*, 52*a*, which are each provided for guidance in an outer curve 24*a*, 26*a* of the piston 16*a*. The form closure elements 50*a*, 52*a* are realized as pins. The form closure elements 50*a*, 52*a* in this case are fixedly connected to the cylinder 14*a* of the impact mechanism device. The form closure elements 50*a*, 52*a* are fixedly disposed at a position on the cylinder 14*a*. For the purpose of fastening the form closure elements 50*a*, 52*a*, the cylinder 14*a* has a radially extending through hole 70*a* in each case. The form closure elements 50*a*, 52*a* in this case are each respectively disposed in one of the through holes 70*a*, and thereby connected to the cylinder 14*a* in a stationary manner, but having play and being rotatable. The form closure elements 50*a*, 52*a* are each fixedly disposed in the through holes 70*a* by means of press fits. In a mounted state, the form closure elements 50*a*, 52*a* project inwardly into the cylinder 14*a*. In a mounted state, the form closure elements 50*a*, 52*a* are disposed in the outer curves 24*a*, 26*a* of the piston 16*a* by an inner region projecting inwardly into the cylinder 14*a*. As a result, the piston 16*a* is guided in a constrained manner in relation to the cylinder 14*a* by means of the form closure elements 50*a*, 52*a* and the outer curves 24*a*, 26*a*. Upon a relative rotation between the cylinder 14*a* and the piston 16*a*, the piston 16*a* is moved axially back and forth inside the cylinder 14*a* by the cam mechanism 18*a*.

For the purpose of transmitting a rotational speed and a torque from the drive unit 58*a* to the impact mechanism 12*a*, the impact mechanism device comprises a first planetary gearing 72*a*. The first planetary gearing 72*a* comprises a sun gear 74*a*, three planet gears 76*a* that mesh radially outwardly on the sun gear 74*a*, a planet carrier 78*a*, which carries the planet gears 76*a* in a rotatable manner in each case, and a ring gear 80*a*, which is disposed radially outside of the planet gears 76*a*, and which meshes with the planet gears 76*a*. The sun gear 74*a* is connected in a rotationally fixed manner to the drive shaft 60*a*, which is directly driven by the drive unit 58*a*. Via the sun gear 74*a*, a rotation is introduced into the first planetary gearing 72*a*. The ring gear 80*a* of the first planetary gearing 72*a* is connected in a rotationally fixed manner to a housing element 82*a* of the machine housing 54*a*, i.e. is stationary. It is also conceivable in principle for the ring gear 80*a* of the first planetary gearing 72*a* to be directly connected in a rotationally fixed manner to the machine housing 54*a*. The planet carrier 78*a* of the first planetary gearing 72*a* realizes an output of the first planetary gearing 72*a*, via which a rotation is diverted out of the first planetary gearing 72*a*. The impact mechanism device in this case comprises a rolling bearing 84*a*, by means of which the planet carrier 78*a* is realized so as to be rotatable in relation to the housing element 82*a*. The planet carrier 78*a* extends from a rolling plane, on which the planet gears 76*a*, the sun gear 74*a* and the ring gear 80*a* mesh with each other, in the direction of the tool receiver 38*a* and away from the drive unit 58*a*. The impact mechanism device comprises a second planetary gearing 22*a*. The second planetary gearing 22*a* is positioned after the first planetary gearing 72*a*, as viewed from the drive unit 58*a*. The second planetary gearing 22*a*, as also the first planetary gearing 72*a*, has a sun gear 28*a*, three planet gears 86*a* that mesh radially outwardly on the sun gear, a planet carrier 48*a*, which carries the planet gears 86*a* in a rotatable manner in each case, and a ring gear 46*a*, which is disposed radially outside of the planet gears 86*a*, and which meshes with the planet gears 86*a*. The sun gear 28*a* of the second planetary gearing 22*a* realizes an input of the second planetary gearing 22*a*. The sun gear 28*a* of the second planetary gearing 22*a* is connected in a rotationally fixed manner to the planet carrier 78*a* of the first planetary gearing 72*a*. The sun gear 28*a* of the second planetary gearing 22*a* is also realized as a first output of the second planetary gearing 22*a*, and realized to drive the impact mechanism 12*a*. The ring gear 46*a* of the second planetary gearing 22*a* is connected in a rotationally fixed manner to the housing element 82*a* of the machine housing 54*a*, i.e. is stationary. It is also conceivable in principle for the ring gear 46*a* of the second planetary gearing 22*a* to be directly connected in a rotationally fixed manner to the machine housing 54*a*. The planet carrier 48*a* of the second planetary gearing 22*a* is realized as a second output of the second planetary gearing 22*a*, and likewise provided to drive the impact mechanism 12*a*.

For the purpose of driving the impact mechanism 12*a*, the first output of the second planetary gearing 22*a* is coupled in a rotationally fixed manner to the cylinder 14*a* of the impact mechanism 12*a*. The sun gear 28*a* of the second planetary gearing 22*a* is connected in a rotationally fixed manner to the cylinder 14*a* of the impact mechanism 12*a*. It would also be conceivable in principle for the cylinder 14*a* of the impact mechanism 12*a* to constitute a single piece with the sun gear 28*a* of the cylinder 14*a*. The second output, i.e. the planet carrier 48*a* of the second planetary gearing 22*a*, is connected in a rotationally fixed manner to the piston 16*a* of the impact mechanism 12*a*. If the first output, i.e. the sun gear 28*a*, and the second output, i.e. the planet carrier 48*a*, have differing rotational speeds, a differential rotational speed ensues between the cylinder 14*a* and the piston 16*a*, as a result of which the cam mechanism 18*a* generates axial driving of the piston 16*a* inside the cylinder 14*a*. If the second planetary gearing 22*a* is in an unblocked state, the sun gear 28*a*, i.e. the first output, and the planet carrier 48*a* always have differing rotational speeds. The tool receiver 38*a* is likewise driven via the second output, i.e. the planet carrier 48*a* of the planetary gearing 22*a*. In this case, the second output, i.e. the planet carrier 48*a* of the planetary gearing 22*a*, drives the tool receiver 38*a* rotationally, causing a tool that is present in the tool receiver 38*a* to rotate. In this case, a coupling point, not represented in greater detail in FIG. 1, is integrated between the planet carrier 48*a* of the planetary gearing 22*a* and the tool receiver 38*a*, by means of which coupling point a rotationally fixed connection between the planet carrier 48*a* of the second planetary gearing 22*a* and the tool receiver 38*a* can optionally be made or undone. The coupling point can be used to switch on or switch off a drilling operating mode of the hand power tool 10*a*. For the purpose of deactivating an impact operating mode, in which the impact mechanism 12*a* impacts on the tool clamped in the tool receiver 38*a*, either in addition to a rotation or exclusively, the impact mechanism device has a further coupling point, not represented in greater detail in FIG. 1. The coupling point may be provided, for example, to block the second planetary gearing 22*a*. As a result of blocking of the second planetary gearing 22*a*, the sun gear 28*a* and the planet carrier 48*a*, i.e. the first output and the second output of the second planetary gearing 22*a*, rotate at the same rotational speed, such that there would be no relative rotational speed between the cylinder 14*a* and the piston 16*a*, as a result of which the axial movement of the piston 16*a* inside the cylinder 14*a* is prevented by the cam mechanism 18*a*.

Further exemplary embodiments of the disclosure are shown in FIGS. 3 to 6. The descriptions that follow and the drawings are each limited substantially to the differences between the exemplary embodiments, and in principle reference may also be made to the drawings and/or to the description of the other exemplary embodiments, in particular of FIGS. 1 and 2, in respect of components having the same designation, in particular relating to components having the same references. To distinguish the exemplary embodiments, the letter a has been appended to the references of the exemplary embodiment in FIGS. 1 and 2. In the exemplary embodiments of FIGS. 3 to 6, the letter a has been replaced by the letters b, d, e.

Figure 3:
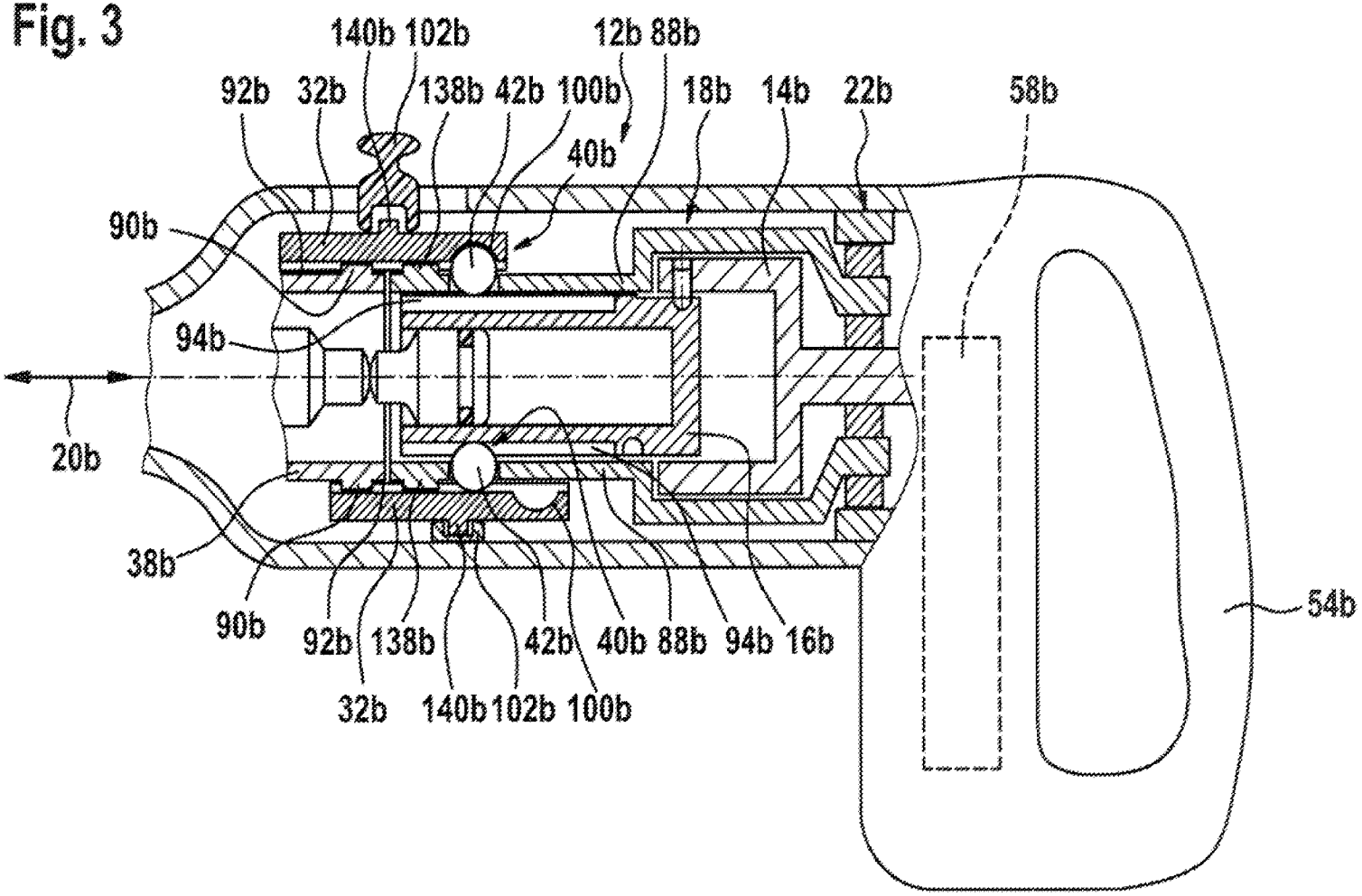
FIG. 3 shows a schematic representation of an impact mechanism device, in a second exemplary embodiment.
Figure 4:
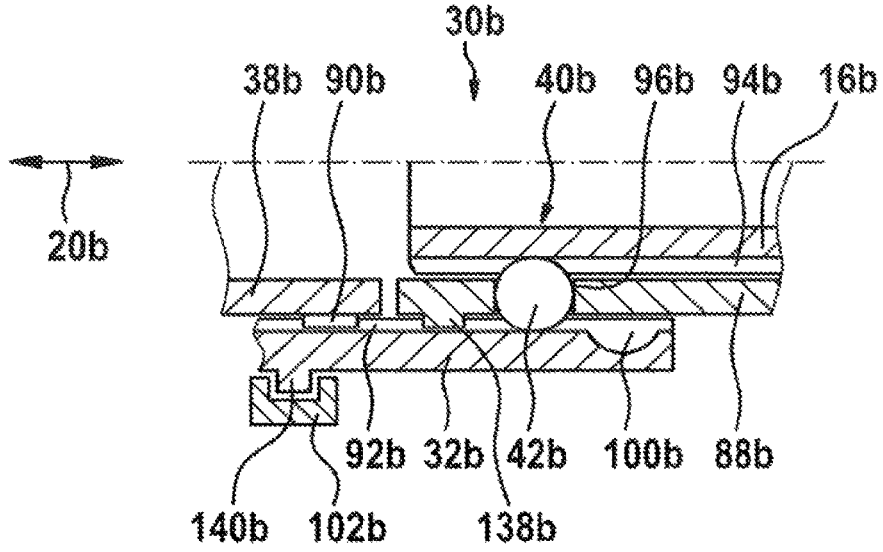
FIG. 4 shows a portion of a switching device of the impact mechanism device, in the second exemplary embodiment.

FIGS. 3 and 4 show a second exemplary embodiment of an impact mechanism device according to the disclosure. FIGS. 3 and 4 show a hand power tool 10*b* comprising the impact mechanism device according to the disclosure. Unlike the first exemplary embodiment, the hand power tool 10*b*, realized as a rotary hammer, has a differently designed machine housing 54*b*, in which the impact mechanism device according to the disclosure is disposed. The machine housing 54*b* is realized in an L-shaped design. In a manner similar to the first exemplary embodiment, the impact mechanism device likewise has a second planetary gearing 22*b*, a drive unit 58*b*, and an impact mechanism 12*b* comprising a piston 16*b* and a cylinder 14*b*. For the purpose of driving the piston 16*b*, the impact mechanism device in this case has a cam mechanism 18*b*, which drives the piston 16*b* via the cylinder 14*b*. The second planetary gearing 22*b*, and the cylinder 14*b* and the piston 16*b*, are realized in a manner that is substantially equivalent to the first exemplary embodiment.

The impact mechanism device comprises a switching device 30*b* for switching various operating modes of the hand power tool 10*b*. Three operating modes, namely chiseling, hammer drilling and drilling, can be switched by means of the switching device 30*b*. In this case, the switching device 30*b* is realized as a mechanical switching device 30*b*. The various operating modes can be adjusted in a purely mechanical manner by means of the switching device 30*b*. The switching device 30*b* comprises a slide sleeve 32*b*, which is disposed in a front region of the piston 16*b*, at a transition to a tool receiver 38*b*. In this case, the slide sleeve 32*b* is disposed radially outside of a driver element 88*b*, via which the piston 16*b* can be driven by a second output of the second planetary gearing 22*b*. The driver element 88*b* is realized as a hollow cylinder, which is disposed radially outside of the piston 16*b*. The driver element 88*b* is connected in a rotationally fixed manner to the second output of the second planetary gearing 22*b*. The slide sleeve 32*b* is axially displaceable in this case. For the purpose of switching the three operating modes, the slide sleeve 32*b* has three switching positions. Each of the three switching positions is represented in this case by an axial position of the slide sleeve 32*b* on the driver element 88*b*. The slide sleeve 32*b* is connected in a rotationally fixed manner to the driver element 88*b*. The driver element 88*b* comprises form closure elements 138*b*, via which the slide sleeve 32*b* is connected in a form-closed manner to the driver element 88*b*. The slide sleeve 32*b* has form closure elements 92*b*, which are realized to correspond to the form closure elements 138*b*. For the purpose of connecting the slide sleeve 32*b* in a rotationally fixed manner, the form closure elements 138*b* of the driver element 88*b* and the form closure elements 92*b* of the slide sleeve 32*b* engage in each other in a form-closed manner. It is conceivable in this case for the form closure elements 92*b*, 138*b* to be realized as a toothing. As a result, the slide sleeve 32*b* can only be displaced axially on the driver element 88*b*, but not turned in relation to the latter. The slide sleeve 32*b* projects beyond the driver element 88*b* in the direction of the tool receiver 38*b*. On a side that faces toward the driver element 88*b*, the tool receiver 38*b* has a plurality of form closure elements 90*b*, which are provided for coupling to the slide sleeve 32*b*. The form closure elements 90*b* in this case are realized as protrusions disposed in a distributed manner on a circumference of the tool receiver 38*b*, which protrude radially outward. It is also conceivable in principle for the form closure elements 90*b* to be realized as teeth of a toothing disposed on the circumference of the tool receiver 38*b*. The form closure elements 92*b* of the slide sleeve 32 are likewise realized to correspond to the form closure elements 90*b* of the tool receiver 38*b*. If the tool receiver 38*b* and the slide sleeve 32*b* are connected to each other via their form closure elements 90*b*, 92*b*, the tool receiver 38*b* and the slide sleeve 32*b* are coupled to each other in a rotationally fixed manner. In this case, a rotation introduced into the slide sleeve 32*b* via the driver element is transmitted to the tool receiver 38*b*, and a tool clamped in the tool receiver 38*b* rotates. In the first switching position and in a second switching position, the form closure elements 92*b* of the slide sleeve 32*b* engage in the form closure elements 90*b* of the tool receiver. As a result, the tool receiver 38*b* is driven rotationally in the first and in the second switching position of the slide sleeve 32*b*. In the third switching position of the slide sleeve 32*b*, the form closure elements 92*b* of the slide sleeve 32*b* are separated from the form closure elements 90*b* of the tool receiver 38*b*, as a result of which a rotationally fixed coupling of the tool receiver 38*b* and the slide sleeve 32*b* is disconnected. In this case, the first switching position is realized as a position of the slide sleeve 32*b* shifted maximally in the direction of the tool receiver 38*b*. The second switching position is realized as a middle position of the slide sleeve 32*b*. Accordingly, the third switching position of the slide sleeve 32*b* is realized as position of the slide sleeve 32*b* that is maximally in the direction of the second planetary gearing 22*b*, i.e. maximally distant from the tool receiver 38*b*.

For the purpose of deactivating an impact operating mode of the impact mechanism 12*b*, the switching device 30*b* comprises a coupling point 40*b*. The coupling point 40*b* is provided for separably coupling the piston 16*b* and the river element 88*b*. For this purpose, the piston 16*b* has, on a region that faces toward the driver element 88*b*, a plurality of form closure elements 94*b* disposed on an offset outer circumference. The form closure elements 94*b* in this case are realized as protrusions, which extend radially outward from the outer circumference of the piston 16*b*. For the purpose of coupling to the form closure elements 94*b* of the piston 16*b*, the coupling point 40*b* has radially displaceable form closure elements 42*b*. The radially displaceable form closure elements 42*b* are realized as balls, which are each disposed in a radially extending through recess 96*b* in the driver element 88*b*. It is also conceivable in principle for the form closure elements 42*b* coupled to the driver element 88*b* to be realized, for example, as pins. The form closure elements 42*b* coupled to the driver element 88*b* each have two switching positions. In a first switching position, the form closure elements 42*b* project radially inward into the driver element 88*b*, and in this case they come into form-closed contact with the form closure elements 94*b* of the piston 16*b* and thus couple the piston 16*b* in a rotationally fixed manner to the driver element 88*b*. As a result, in a first switching position of the form closure elements 42*b*, the piston 16*b* rotates at a rotational speed of the driver element 88*b*, and a differential rotational speed between the piston 16*b* and the cylinder 14*b* causes the piston 16*b* to be moved axially back and forth in an impact motion, by means of the cam mechanism 18*b*. In this case, the form closure elements 42*b*, by a radially outer end, bear against a radial inside 98*b* of the slide sleeve 32*b*. As a result, the form closure elements 42*b* are held in a form closure in the first position by the slide sleeve 32*b*. In this case, in the second and third switching positions of the slide sleeve 32*b*, the form closure elements 42*b* are held by the slide sleeve 32*b* in the first switching position. As a result, an impact operating mode of the impact mechanism 12*b* is activated in the second and third switching positions of the slide sleeve 32*b*. For the purpose of deactivating the impact operating mode of the impact mechanism 12*b*, the slide sleeve 32*b* has a recess 100*b* each form closure element 42*b* coupled to the driver element 88*b*, the recesses 100*b* being disposed on the radial inside 98*b* of the slide sleeve 32*b*. The recesses 100*b* in this case are all made at the same axial position in the inside 98*b* of the slide sleeve 32*b*. In the first switching position of the slide sleeve 32*b*, the recesses 100*b* are congruent with the radially displaceable form closure elements 42*b* coupled to the driver element 88*b*. As a result, the form closure elements 42*b* coupled to the driver element 88*b* in the first switching position of the slide sleeve 32*b* slide radially outward into their second switching position, into the congruently disposed recesses 100*b* in the inside 98*b* of the slide sleeve 32*b*. In this case, the form closure elements 42*b* are driven radially outward into the recesses 100*b* by the centrifugal forces that occur upon a rotation of the driver element 88*b*. In the second switching position of the form closure elements 42*b*, in which they are disposed in the respective recesses 100*b*, the form closure elements 42*b* are separated from the form closure elements 94*b* of the piston 16*b*. A form-closed connection between the form closure elements 94*b* of the piston 16*b* and the form closure elements 42*b* coupled to the driver element 88*b* is undone in the second switching position of the form closure elements 42*b*, which go into the first switching position of the slide sleeve 32*b*, as a result of which a rotationally fixed coupling of the piston 16 to the driver element 88*b* is undone. The slide sleeve 32*b*, in its first switching position, releases the form closure elements 42*b*.

In the first switching position of the slide sleeve 32*b*, the tool receiver 38*b* is connected in a rotationally fixed manner to the slide sleeve 32 via the form closure elements 90*b*, 92*b*. The form closure elements 42*b* coupled to the driver element 88*b* are disposed in the respective recesses 100*b* of the slide sleeve 32*b* and separated from the form closure elements 94*b* of the piston 16*b*. The first switching position of the slide sleeve 32*b* thereby generates the operating mode of drilling, in which only the tool receiver 38*b* rotates, but no impact pulse is generated by the impact mechanism 12*b*. In the second switching position of the slide sleeve 32*b*, the tool receiver 38*b* is connected in a rotationally fixed manner to the slide sleeve 32 via the form closure elements 90*b*, 92*b*. The form closure elements 42*b* coupled to the driver element 88*b* are pressed radially inward, via the inside 98*b* of the slide sleeve 32*b*, and are in form-closed contact with the form closure elements 94*b* of the piston 16*b*, such that the piston 16*b* is coupled in a rotationally fixed manner to the driver element 88*b*. As a result, the second, middle switching position of the slide sleeve 32*b* generates the operating mode of hammer drilling, in which the tool receiver 38*b* rotates and an impact pulse is additionally generated by the impact mechanism 12*b*. In the third switching position of the slide sleeve 32, the tool receiver 38*b* is separated from the slide sleeve 32. The form closure elements 92*b* of the slide sleeve 32*b* are separated from the form closure elements 90*b* of the tool receiver 38*b*. In the third switching position of the slide sleeve 32, the form closure elements 42*b* coupled to the driver element 88*b* are pressed radially inward, via the inside 98*b* of the slide sleeve 32*b*, and are in form-closed contact with the form closure elements 94*b* of the piston 16, such that the piston 16 is coupled in a rotationally fixed manner to the driver element 88*b*. As a result, the third switching position of the slide sleeve 32*b* generates the operating mode of chiseling, in which the tool receiver 38*b* does not rotate, and only an impact pulse is generated by the impact mechanism 12*b*. The switching device 30*b* in this case comprises an actuating element 102*b*, by means of which an operator can manually switch the slide sleeve 32*b* into the various switching positions. The actuating element 102*b* is realized as a sleeve, which encompasses the slide sleeve 32*b*. In this case, a lever element of the actuating element 102*b* projects out of the machine housing 54*b*, from which it can be contacted and operated by an operator. The slide sleeve 32*b* comprises a driver element 140*b*, via which the slide sleeve 32*b* is coupled to the actuating element 102*b*. The driver element 140*b* is realized as a protrusion that extends on the outside of the slide sleeve 32*b* and that is in form-closed contact with the driver element for the purpose of coupling to the actuating element 102*b*. It is also conceivable in principle for the slide sleeve 32*b* to be displaced directly by an operator.

Figure 5:
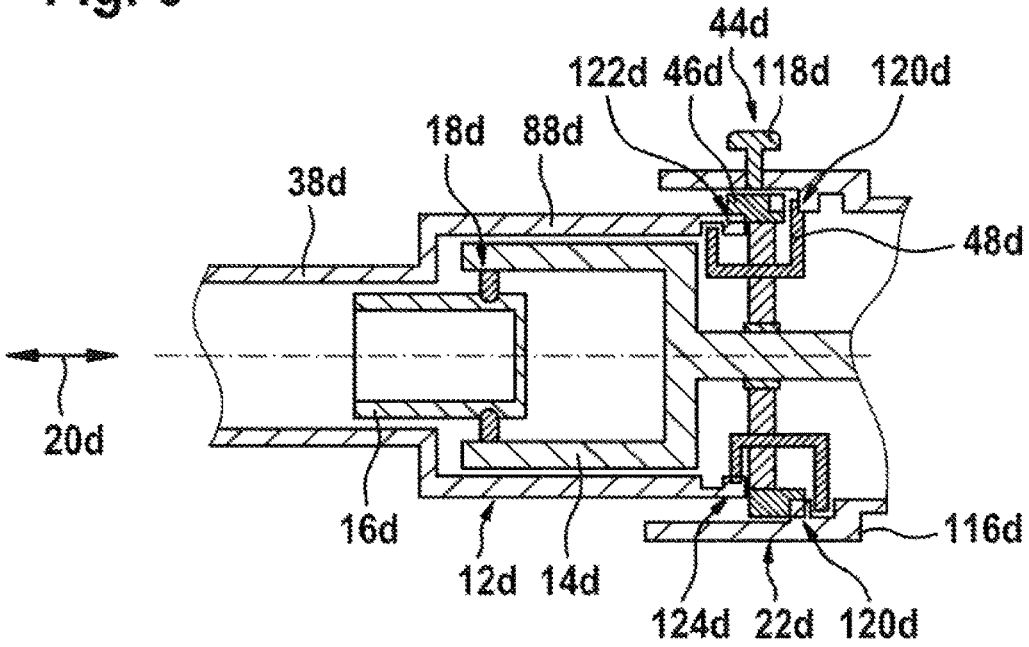
FIG. 5 shows a schematic representation of an impact mechanism device, in a third exemplary embodiment.

FIG. 5 shows a third exemplary embodiment of an impact mechanism device according to the disclosure. The impact mechanism device is realized in substantially the same manner as the impact mechanism device from the first exemplary embodiment from FIGS. 1 and 2. In this case, the impact mechanism device is represented merely schematically here. In a manner similar to the first exemplary embodiment, the impact mechanism device likewise has a second planetary gearing 22*d*, and an impact mechanism 12*d* comprising a piston 16*d* and a cylinder 14*d*. The second planetary gearing 22*d*, and the cylinder 14*d* and the piston 16*d*, are realized in a manner that is substantially equivalent to the first exemplary embodiment. In this case, for the purpose of driving the piston 16*d*, the impact mechanism device has a cam mechanism 18*d*, which drives the piston 16*d* via the cylinder 14*d*.

The impact mechanism device comprises a mechanical switchover unit 44*d*, by means of which the direction of rotation of a tool, disposed in a tool receiver 38*d*, can be reversed. The mechanical switchover unit 44*d* in this case for switching over the direction of rotation is provided to fix optionally a ring gear 46*d* or a planet carrier 48*d* of the second planetary gearing 22*d*. The mechanical switchover unit 44*d* comprises a switching sleeve 116*d*, which is displaceable in an axial direction 20*d*. Mounted on the switching sleeve 116*d* in this case is an actuating element 118*d*, by means of which an operator can displace the switching sleeve 116*d* in the axial direction 20*d*. The second planetary gearing 22*d* is mounted inside the switching sleeve 116*d*. The switching sleeve 116*d* comprises a form closure element 120*d*, via which the switching sleeve 116*d* can be coupled in a rotationally fixed manner to the ring gear 46*d* or to the planet carrier 48*d* of the second planetary gearing 22*d*. The switching sleeve 116*d* comprises a first switching position and a second switching position. To illustrate the two differing switching positions, FIG. 5 shows an upper half of the impact mechanism device with the switching sleeve 116*d* in the first switching position and a lower half of the impact mechanism device with the switching sleeve 116*d* in the second switching position. In the first switching position of the switching sleeve 116*d*, the planet carrier 48*d* is connected in a rotationally fixed manner to the switching sleeve 116*d*, via the form closure element 120*d*, and is thereby fixed. The ring gear 46*d* of the second planetary gearing 22*d* can rotate and, via a coupling point 122*d*, is connected in a rotationally fixed manner to a driver element 88*d* of the impact mechanism device that is provided for rotationally driving the tool receiver 38*d* and the piston 16*d* of the impact mechanism 12*d*. This results in driving of the driver element 88*d*, i.e. the tool receiver 38*d* and the piston 16*d*, via the ring gear 46*d* of the second planetary gearing 22*d* that, in this switching position, is realized as an output of the second planetary gearing 22*d*. For the purpose of switching over into the second switching position, the switching sleeve 116*d* is displaced in the axial direction 20*d*, in the direction of the tool receiver 38*d*. In the second switching position, the form closure element 120*d* is coupled to the ring gear 46*d* of the second planetary gearing 22*d*, and thus fixes the latter. The planet carrier 48*d* of the second planetary gearing 22*d* can rotate and, via a coupling point 124*d*, is connected in a rotationally fixed manner to the driver element 88*d* of the impact mechanism device. This results in driving of the driver element 88*d*, i.e. the tool receiver 38*d* and the piston 16*d*, via the planet carrier 48*d* of the second planetary gearing 22*d* that, in this switching position, is realized as an output of the second planetary gearing 22*d*. The switchover of the output of the second planetary gearing 22*d*, which in the first switching position is constituted by the ring gear 46*d* and in the second switching position is constituted by the planet carrier 48*d*, the planet carrier 48*d* being fixed in the first switching position and the ring gear 46*d* being fixed in the second switching position, causes a direction of rotation of the driver element 88*d* to be reversed, respectively, in both switching positions. As a result, an operator can easily effect mechanical switchover of a direction of rotation of a tool in the tool receiver 38*d*.

Figure 6:
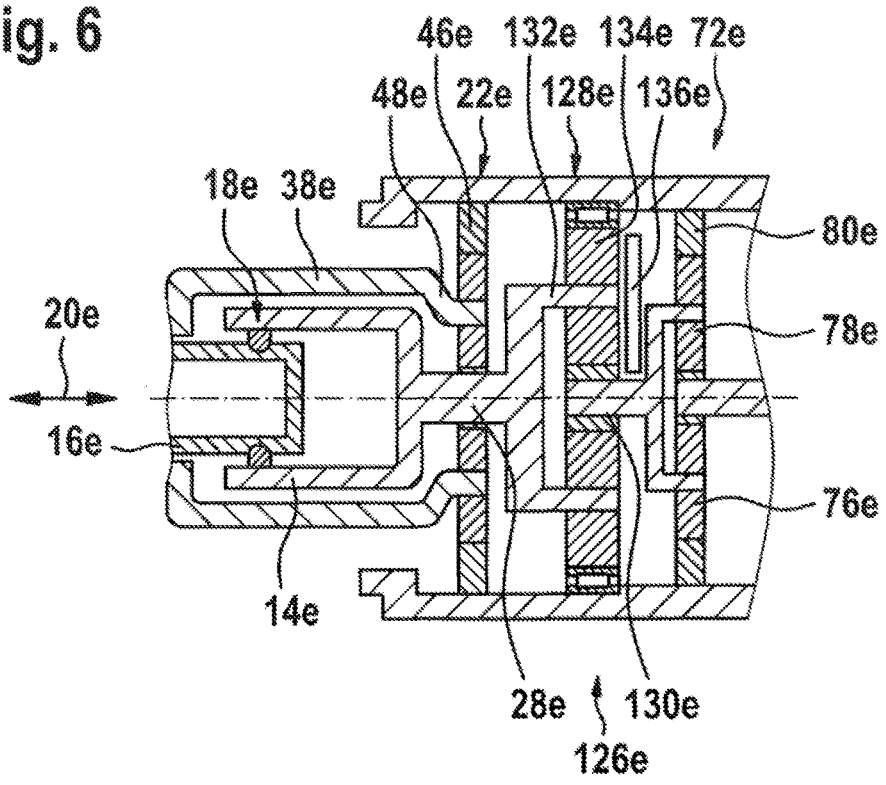
FIG. 6 shows a schematic representation of an impact mechanism device, in a fourth exemplary embodiment.

FIG. 6 shows a fourth exemplary embodiment of a impact mechanism device according to the disclosure. The impact mechanism device is realized in substantially the same manner as the impact mechanism device from the first exemplary embodiment from FIGS. 1 and 2. In this case, the impact mechanism device is represented merely schematically here. In a manner similar to the first exemplary embodiment, the impact mechanism device likewise has an impact mechanism 12*e* comprising a piston 16*e* and a cylinder 14*e*. The second planetary gearing 22*e*, and the cylinder 14*e* and the piston 16*e*, are realized in a manner that is substantially equivalent to the first exemplary embodiment. In this case, for the purpose of driving the piston 16*e*, the impact mechanism device has a cam mechanism 18*e*, which drives the piston 16*e* via the cylinder 14*e*. The impact mechanism device comprises a gearing device 126*e*, by means of which two gears can be switched. In the differing gear, the gearing device 126*e* has respectively differing gear ratios. For the purpose of realizing the gearing device 126*e*, the impact mechanism device, as in the first exemplary embodiment from FIGS. 1 and 2, has a first planetary gearing 72*e* and the second planetary gearing 22*e*. The gearing device 126*e* has a third planetary gearing 128*e*, which is disposed between the first planetary gearing 72*e* and the second planetary gearing 22*e*. A planet carrier 78*e* of the first planetary gearing 72*e* is coupled to a sun gear 130*e* of the third planetary gearing 128*e*. A planet carrier 132*e* of the third planetary gearing 128*e* is coupled in a rotationally fixed manner to a sun gear 28*e* of the second planetary gearing 22*e*. A ring gear 134*e* of the third planetary gearing 128*e* is rotatably mounted. The gearing device 126*e* comprises a switching element 136*e*, which is provided for blocking the third planetary gearing 128*e*. The switching element 136*e* in this case is shown only schematically in FIG. 6. In the first switching position of the switching element 136*e*, the third planetary gearing 128*e* is unblocked. In the second switching position of the switching element 136*e*, the third planetary gearing 128*e* is blocked. For the purpose of blocking the third planetary gearing 128*e*, the switching element 136*e* connects the ring gear 134*e* of the third planetary gearing 128*e* in a rotationally fixed manner to the sun gear 130*e* of the third planetary gearing 128*e*. As a result, the third planetary gearing 128*e* is blocked and, as it were, bridged. A rotational speed is no longer converted in the third planetary gearing 128*e*. For the same input rotational speed, via the sun gear 130*e*, the planet carrier 132*e*, in a first switching position of the switching element 136*e*, has a different rotational speed than in the second switching position of the switching element 136*e*.

It is also conceivable in principle for the gearing device 126*e* to be designed in a different manner, considered appropriate by persons skilled in the art, for switching various gear speeds in the hand power tool 10*e*. It is thus conceivable, for example, for only two planetary gearings 22*e*, 72*e* to be provided for switching various gear speeds, and for switching of the various gear speeds to be effected by releasing and holding either the ring gear or the planet carrier of the corresponding planetary gearing 22*e*, 72*e*.

It is also to be noted here, in principle, that the differing exemplary embodiments may also be combined in a common hand power tool 10. It is thus conceivable, for example, for switching of the operating modes from the second exemplary embodiment to be combined with the gearing device from the fifth exemplary embodiment. Further combinations are likewise conceivable.

What is claimed is:

1. An impact mechanism device for a hand power tool, comprising:

at least one impact mechanism including at least one driven cylinder configured for rotation and defining a radially inner space and at least one piston positioned at least partially inside the at least one driven cylinder within the radially inner space;

at least one planetary gearing configured to drive the at least one driven cylinder and the at least one piston; and a cam mechanism configured to drive the at least one piston in an axial direction by rotation of the at least one driven cylinder, the cam mechanism including (i) a first form closure element fixedly extending from the at least one driven cylinder into the radially inner space, and (ii) a first groove defined on an outer surface of the at least one piston and configured to receive the first form closure element.

2. The impact mechanism device according to claim 1, wherein the at least one piston is at least one hollow piston configured to move axially to generate a pressure impulse.

3. The impact mechanism device according to claim 1, wherein the cam mechanism further includes:

a second groove defined on the outer surface of the at least one piston, wherein the first groove extends completely around the at least one piston, wherein the second groove extends completely around the at least one piston, and wherein the first groove intersects the second groove.

4. The impact mechanism device according to claim 3, wherein the first groove and the second groove are distributed in a non-uniform manner on the outer surface of the at least one piston.

5. The impact mechanism device according to claim 3, wherein:

the at least one piston is formed from a first material;

the first groove and the second groove are formed from a different second material; and the first material is softer than the second material, such that the first groove and the second groove are more resistant to wear than a remaining portion of the at least one piston.

6. The impact mechanism device according to claim 1, wherein:

the at least one planetary gearing includes a first output and a second output;

the at least one driven cylinder is directly connected and rotationally driven by the first output; and the at least one piston is directly connected and rotationally driven by the second output.

7. The impact mechanism device according to claim 6, wherein the first output is a sun gear of the at least one planetary gearing.

8. The impact mechanism device according to claim 1, further comprising at least one switching device configured to mechanically switch between various operating modes.

9. The impact mechanism device according to claim 8, wherein:

the at least one switching device includes at least one slide sleeve having other form closure elements; and the other form closure elements are configured to couple to a tool receiver and are further configured to actuate a coupling point of the switching device to couple the at least one piston.

10. The impact mechanism device according to claim 9, wherein the coupling point comprises radially displaceable further form closure elements configured to be held in a form closure or released by the at least one slide sleeve to couple or decouple the at least one piston.

11. The impact mechanism device according to claim 1, further comprising:

a mechanical switchover unit; and a tool receiver, wherein the at least one planetary gearing includes a first planetary gearing and a second planetary gearing; and wherein the mechanical switchover unit is configured to switch over a direction of rotation of the tool receiver to optionally fix a ring gear or a planet carrier of the second planetary gearing.

12. A hand power tool comprising:

an impact mechanism device, including:

at least one impact mechanism having at least one driven cylinder configured for rotation and defining a radially inner space and at least one piston positioned completely inside the at least one driven cylinder within the radially inner space;

at least one planetary gearing configured to drive the at least one driven cylinder and the at least one piston; and a cam mechanism configured to drive the at least one piston in an axial direction by rotation of the at least one driven cylinder, the cam mechanism including (i) a first form closure element, and (ii) a first groove defined on an outer surface of the at least one piston and configured to receive the first form closure element.

13. A hand power tool, comprising:

an impact mechanism device, including:

at least one impact mechanism having at least one driven cylinder configured for rotation and defining a radially inner space and at least one piston positioned at least partially inside the at least one driven cylinder within the radially inner space;

at least one planetary gearing configured to drive the at least one driven cylinder and the at least one piston; and a cam mechanism configured to drive the at least one piston in an axial direction by rotation of the at least one driven cylinder, the cam mechanism including a first groove and a second groove defined on the outer surface of the at least one piston, wherein the first groove extends completely around the at least one piston, wherein the second groove extends completely around the at least one piston, and wherein the first groove is different from the second groove.

14. The hand power tool according to claim 13, wherein the first groove intersects the second groove.

* * * * *